US005166045A

United States Patent [19]

Wu

[11] Patent Number: 5,166,045

[45] Date of Patent: Nov. 24, 1992

[54] DOPING OF SILVER HALIDE EMULSIONS WITH GROUP VIB COMPOUNDS TO FORM IMPROVED PHOTOACTIVE GRAINS

[75] Inventor: George F. L. Wu, Rochester, N.Y.

[73] Assignee: Eastman Kodak Company, Rochester, N.Y.

[21] Appl. No.: 741,841

[22] Filed: Aug. 7, 1991

Related U.S. Application Data

[63] Continuation of Ser. No. 367,904, Jun. 19, 1989, abandoned.

[51] Int. Cl.[5] ..... G03C 1/005

[52] U.S. Cl. ..... 430/569; 430/567; 430/603; 430/608

[58] Field of Search ..... 430/567, 569, 603, 608

[56] References Cited

U.S. PATENT DOCUMENTS

| | | | |
|---|---|---|---|
| 1,602,591 | 10/1926 | Sheppard | 430/603 |
| 1,939,232 | 12/1933 | Sheppard et al. | 430/351 |
| 3,021,212 | 2/1962 | King | 430/406 |
| 3,297,446 | 1/1967 | Dunn | 430/550 |
| 3,297,447 | 1/1967 | McVeigh | 430/543 |
| 3,320,069 | 5/1967 | Illingsworth | 430/605 |
| 3,408,196 | 10/1968 | McVeigh et al. | 430/603 |
| 3,442,653 | 5/1969 | Dunn et al. | 430/603 |
| 3,619,188 | 11/1971 | Alcock et al. | 430/393 |
| 3,772,031 | 11/1973 | Berry et al. | 430/603 |
| 4,433,048 | 2/1984 | Solberg et al. | 430/569 |
| 4,439,520 | 3/1984 | Kofron et al. | 430/603 |

*Primary Examiner*—Charles L. Bowers, Jr.
*Assistant Examiner*—Thomas R. Neville
*Attorney, Agent, or Firm*—Paul A. Leipold

[57] ABSTRACT

The incorporation of dopant during the precipitation of silver halide grains. The silver halide grains are formed by a double jet, accelerated flow technique. After addition of about 65 to 90% of the silver halide mass to be precipitated, a dopant solution of an Group VIB salt in an amount of between about 0.2 and about 1.0 mg salt per mole of silver is added to the precipitation dispersion. The dispersion formation is then allowed to complete by continuing the double jet precipitation technique until a desired grain size is reached. Grains formed by this process will have their outer third comprising the Group VI metal salt with the silver halide. In the preferred method the Group VIB metal salt added is a selenium salt comprising potassium selenocyanate.

14 Claims, No Drawings

DOPING OF SILVER HALIDE EMULSIONS WITH GROUP VIB COMPOUNDS TO FORM IMPROVED PHOTOACTIVE GRAINS

This is a continuation of application Ser. No. 367,904, filed Jun. 19, 1989, now abandoned.

FIELD OF THE INVENTION

This invention relates to radiation sensitive material. It particularly relates to radiation sensitive silver halide grains and their preparation.

PRIOR ART

In the preparation of high quality photographic materials it is generally necessary to increase the sensitivity of the radiation sensitive silver halides. Accordingly it is known that silver halide emulsions can be chemically sensitized by adding sensitizers of certain material such as sulfur or gold after formation of silver halide grains.

Photographic products may be chemically sensitized with chemical sensitizers such as with reducing agents such as sulfur, selenium, tellurium, gold, platinum, or palladium compounds.

In U.S. Pat. No. 4,439,520-Kofron et al and U.S. Pat. No. 4,433,048-Solberg et al it has been proposed that emulsions for use in photographic films be formed utilizing high aspect ratio silver halide grains. It has further been proposed that these high aspect ratio silver halide grains be chemically and spectrally sensitized in order to create particularly useful photographic products, note Kofron et al. It has been proposed in U.S. Pat. No. 3,772,031-Berry et al that doping of silver halide grains be carried out utilizing a variety of sulfur group compounds. The doping is carried out such that the compounds are substantially uniformly dispersed throughout the interior of the grains.

The tabular silver halide grains such as disclosed in the above patents of Kofron et al and Solberg et al patents have been successful in producing grains that have superior speed-granularity relationship. Nevertheless it is desired that films of even higher performance be formed that can be enlarged to even greater extent without excessive granularity.

THE INVENTION

An object of the invention is to produce films having improved speed-granularity relationship.

Another object of the invention is to provide a process resulting in improved silver halide grains.

These and other objects of the invention are generally performed by the incorporation of a dopant during the precipitation of silver halide grains. The silver halide grains are formed by an accelerated flow technique. The double jet precipitation technique is preferably used for the invention. After addition of about 65 to 90% of the silver halide mass to be precipitated, a dopant solution of an inorganic or organo-metallic Group VIB salt in an amount of between about $1.4\times10^{-6}$ and about $7\times10^{-5}$ mole salt per mole of silver is added to the precipitation dispersion. The dispersion formation is then completed by continuing the double jet precipitation technique until a desired grain size is reached. Grains formed by this process will have their outer third comprising the Group VIB metal with silver halide. In the preferred method the Group VIB metal is added as selenium salt comprising potassium selenocyanate.

MODES OF PRACTICING THE INVENTION

The invention provides several advantages over prior practices. The emulsions of the invention provide better raw stock keeping, and improved speed/fog ratio. By speed/fog ratio it is meant that a higher speed film is possible at the same amount of fog or less fog is possible at the same speed. Also the invention process is more efficient in that doping of the emulsions during precipitation produces a better speed/fog ratio than attempting to achieve the same effect by sensitization processes. This is because with doping it is easier to control fog and rate of sensitization.

Generally the formation of the silver halide emulsions of the invention may be carried out by processes such as generally disclosed in U.S. Pat. No. 4,439,520-Kofron et al referred to above and hereby incorporated by reference.

It has been discovered that improved silver halide emulsions may be formed by doping silver halide grain with a Group VIB salt in an amount of between about 0.2 and about 1.0 mg per mole of silver during the later stage of precipitation. A silver halide grain is formed by emulsion precipitation process, sensitized, and coated into a multilayer color film to result in a film that has surprisingly improved raw stock keeping properties, improved speed/fog ratio and more reliable reproducibility than when the speed/fog ratio is attempted to be improved only by sensitization.

In forming the preferred tabular grain emulsions of this invention, a dispersing medium is initially contained in the reaction vessel. In a preferred form the dispersing medium is comprised of an aqueous peptizer suspension. Peptizer concentrations of from 0.2 to about 10 percent by weight, based on the total weight of emulsion components in the reaction vessel, can be employed. It is common practice to maintain the concentration of the peptizer in the reaction vessel in the range of below about 6 percent, based on the total weight, prior to and during silver halide formation and to adjust the emulsion vehicle concentration upwardly for optimum coating characteristics by subsequent supplemental vehicle additions. It is contemplated that the emulsion as initially formed will contain from about 5 to 50 grams of peptizer per mole of silver halide, preferably about 10 to 40 grams of peptizer per mole of silver halide. Additional vehicle can be added later to bring the concentration up to as high as 1000 grams per mole of silver halide. Preferably the concentration of vehicle in the finished emulsion is above 50 grams per mole of silver halide. When coated and dried in forming a photographic element the vehicle preferably forms about 30 to 70 percent by weight of the emulsion layer.

Vehicles for the emulsions of the invention, including both binders and peptizers, can be selected from those conventionally employed in photographic silver halide emulsions. Preferred peptizers are hydrophilic colloids, that can be used alone or in combination with hydrophobic materials. Useful hydrophilic materials include both naturally occurring substances, such as proteins, protein derivatives, cellulose derivatives, such as cellulose esters, gelatin, such as alkali treated gelatin or acid treated gelatin, gelatin derivatives, such as acetylated gelatin and phthalated gelatin, polysaccharides, such as dextran, gum arabic, zein, casein, pectin, collagen derivatives, agar-agar, arrowroot and albumin and other vehicles and binders known in the photographic art. Gelatin is highly preferred.

The silver halide emulsions are preferably washed to remove soluble salts. Any of the processes and compositions known in the photographic art for this purpose are useful for washing the silver halide emulsions of the invention. The soluble salts can be removed by decantation, filtration, and/or chill setting and leaching, coagulation washing, by centrifugation, and by other methods and means known in the photographic art.

The photographic silver halide can be chemically sensitized by procedures and with compounds known in the photographic art. For example, the silver halide can be chemically sensitized with active gelatin, or with sulfur, selenium, tellurium, gold, platinum, indium, palladium, osmium, rhodium, rhenium, or phosphorous sensitizers or combinations of these sensitizers, such as at pAg levels within the range of 5 to 10 and at pH levels within the range of 5 to 8 at temperatures within the range of 30° to 80° C. The silver halide can be chemically sensitized in the presence of antifogants, also known as chemical finish modifiers, such as compounds known to suppress fog and increase speed during chemical sensitization, such a azaindenes, azapyridazines, azapyrimidines, benzothiazolium salts, and sensitizers having one or more heterocyclic nuclei. Optionally the silver halide can be reduction sensitized, such as with hydrogen, or through the use of other reducing agents, such a stannous chloride, thiourea dioxide, polyamines or amineboranes. The photographic silver halide emulsion can be spectrally sensitized by, for example, dyes of a variety of classes, including the polymethine dye class, including cyanines, merocyanines, complex cyanines and merocyanines, oxonols, hemioxonols, styryls, merostyryls and streptocyanines. Combinations of spectral sensitizers are also useful.

The photographic silver halide elements can be either single color (monochrome), or multicolor elements. In a multicolor element, a cyan dye-forming coupler is typically associated with a red-sensitive emulsion, a magneta dye-forming coupler is typically associated with a green-sensitive emulsion and a yellow dye-forming coupler is associated with a blue-sensitive emulsion. Multicolor elements typically contain dye-forming units sensitive to each of the three primary regions of the spectrum. Each unit can comprise a single emulsion layer or multiple emulsion layers. The layers of the element and the image-forming units can be arranged in various orders as known in the photographic art. Color photographic reversal materials are preferred for use of the emulsions of this invention.

The photographic element can contain added layers, such as filter layers, interlayers, overcoat layers, subbing layers and other layers known in the art.

In the following discussion of illustrative materials that are useful in elements of the invention reference will be made to *Research Disclosure*, December 1978, Item 17643, published by Kenneth Mason Publications Ltd., Dudley Annex, 21a North Street, Emsworth, Hampshire PO10 7DQ, England, the disclosures of which are incorporated by reference. The publication will be identified hereafter by the term "Research Disclosure".

Any coupler or combination of couplers known in the photographic art can be used with the silver halide emulsions as described. Examples of useful couplers are described in, for example, Research Disclosure Section VII, paragraphs D,E,F and G and in U.S. Pat. No. 4,433,048 and the publications cited therein. The couplers can be incorporated as described in Research Disclosure Section VII and the publications cited therein.

The photographic emulsions and elements can contain addenda known to be useful in the photographic art. The photographic emulsions and elements can contain brighteners (Research Disclosure Section V), antifoggants and stabilizers (Research Disclosure Section VI), antistain agents and image dye stabilizers (Research Disclosure Section VII, paragraphs I and J), light absorbing and scattering materials (Research Disclosure Section VIII), hardeners (Research Disclosure Section XI), plasticizers and lubricants (Research Disclosure Section XII), antistatic agents (Research Disclosure Section XIII), matting agents (Research Disclosure Section XVI) and development modifiers (Research Disclosure Section XXI).

the photographic elements can be coated on a variety of supports, such as film and paper base, as described in Research Disclosure Section XVII and the references described therein.

The photographic elements can be exposed to actinic radiation, typically in the visible region of the spectrum, to form a latent image as described in Research Disclosure Section XVIII and then processed to form a visible image using processes and compositions known in the art, such as described in Research Disclosure Section XIX and U.S. Pat. No. 4,433,048 and the references described therein.

Processing of a color photographic element as described to form a visible dye image includes the step of contacting the element with a color photographic silver halide developing agent to reduce developable silver halide and oxidize the color developing agent. Oxidized color developing agent in turn reacts with at least one coupler to yield a dye.

Preferred color developing agents are p-phenylenediamines. Especially preferred are 4-amino-3-methyl-N,N-diethylaniline hydrochloride, 4-amino-3-methyl-N-ethyl-N-$\beta$-(methanesulfonamido)ethylaniline sulfate hydrate, 4-amino-3-methyl-N-ethyl-N-$\beta$-hydroxyethylaniline sulfate, 4-amino-3-$\beta$-(methanesulfonamido)ethyl-N,N-diethyl-aniline hydrochloride and 4-amino-N-ethyl-N-(2-methoxyethyl)-m-toluidine di-p-toluene sulfonic acid.

With negative working silver halide emulsions this processing step leads to a negative image. To obtain a positive (or reversal) image, this step can be preceded by development with a non-chromogenic developing agent to develop exposed silver halide, but not form dye, and then uniform fogging of the element to render unexposed silver halide developable. The silver halide emulsions of this invention are preferably employed in photographic elements designed to be processed to form a color negative image.

It is specifically contemplated that the doping of the invention will take place during the growth stage of the silver halide grains. During the precipitation process the silver halide grain size is increased by a double jet accelerated flow procedure with silver nitrate and potassium bromide and iodide. Dopant is added after 65 to 90% of the silver halide mass has been precipitated. After a desired size grain has been reached the grain growth is stopped by washing to remove the soluble salts, particularly nitrate and bromide. In accordance with the invention there is added during the last about 65 to 90% of the precipitation process an effective amount of a Group VIB metallic salt. Particularly suitable have been found to be the inorganic-metallic selenium salts. One of the particularly effective salts was found to be potassium selenocyanate in an amount between about $1.4\times10^{-6}$ and about $7\times10^{-5}$ mole per mole of silver for better raw stock keeping and low fog in color films formed utilizing the grains. This addition of potassium selenocyanate at the latter stages of precipitation produces a grain that has dispersed in the outer third of its surface the doping material. The core remains the silver halide, preferably silver bromide and silver iodide, without the doping compound that is present in about the outer third of the grain.

The high aspect ratio tabular grain silver halide emulsions that have been doped with the Group VIB metallic salt, preferably potassium selenocyanate are then preferably chemically sensitized in conventional manner such as discussed in the above-referenced Kofron et al patent. A preferred sensitizing dye for use with the Group VI metal doped silver halide emulsions of the invention are anhydro-5-chloro-9-ethyl-5'-phenyl-3'-(3-sulfobutyl)-3-(sulfopropyl)oxa-carbocyanine hydroxide, sodium salt, and anhydro-11-ethyl-1,1'-bis(3-sulfopropyl)naphth[1,2-d]oxazolocarbocyanine hydroxide, sodium salt.

Generally the emulsion is washed after precipitation is complete to a desired size grain. Washing by coagulation wash to remove the excess bromide ions to stop grain growth at the desired size is preferred. Further the emulsion is redispersed and chilled to about 40° F. to solidify. The emulsion may be remelted and liquefied prior to sensitization with conventional materials such as gold and sulfur. The addition of the inorganic selenium salt is preferably carried out between about 65 and about 90% of desired grain growth. If the selenium salt is added after about 90% of grain growth is done it is at least partially removed during the washing operation and the grain will not have the desired properties. If it is added earlier in the grain formation, a higher level of dopant is required, it may produce higher fog, and it may produce poor raw stock keeping. The optimum time of addition is after about 67 percent of the total silver halide mass to be precipitated has been added to the precipitation for best raw stock keeping and speed/fog ratio increase.

The dopant of the invention may be any Group VIB salt that improves the speed/fog ratio and provides better raw stock keeping. Typical of such organo-metallic salts are tellurocarbamides allyl isotellurocyanate, potassium tellurocyanate, and allyl tellurourea. Preferred are the inorganic metallic selenium salts for good improvement in raw stock keeping. Typical of Group VIB salts are the seleno thiourea salts such as dimethyl seleno thiourea, diethylselenide, selenocarbimides and dimethylselenourea. The optimum material has been found to be potassium selenocyanate salts as they provide good improvement in raw stock keeping, improved speed/fog ratio and are available at reasonable cost. The potassium selenocyanate is added at amount between about $1.4\times10^{-6}$ and about $7\times10^{-5}$ mole per mole of silver. An optimum amount is found to about $1.4\times10^{-6}$ mole (0.2 mg) per mole of silver, as this amount is effective and gives best speed/fog ratio.

The grains of the invention are preferably formed with a silver halide comprising silver bromide and iodide. Generally the grains have an amount between about 1 and about 44 mole percent silver iodide with the remainder 56–99 mole percent silver bromide. A preferred amount has been found to be between about 1 and about 12 mole percent silver iodide with between about 99 and 88 percent silver bromide. The grains suitably have a high aspect ratio of at least 8 to 1. The aspect ratio is preferred to be at least 20 to 1 for best performance as more surface area is present.

The following examples demonstrate the formation process of the silver halide grains of the invention. Further the examples demonstrate the superior performance in regard to raw stock keeping and speed/fog ratio of the emulsions of the invention as compared with other emulsions produced by the Kofron et al process referenced above.

EXAMPLE

A 2.4 μm diameter and 0.12 μm thick silver bromoiodide (overall average iodide 3.0 mole percent) tabular grain emulsion prepared by a double-jet precipitation technique using accelerated flow as follows:

To a 16-liter aqueous gelatin solution (solution A, 0.087 molar sodium bromide, 0.6 percent by weight bone gelatin) at 35° C. and pBr 1.18 are added with stirring over a minute and a half period (consuming 0.18 percent of the total silver) an aqueous silver nitrate solution (solution C-3, 0.376 molar). Twenty liters of aqueous phthalated gelatin solution (solution D, 4% by weight) are added to the reaction vessel. The temperature is then raised to 65° C. The pBr of the contents of the reaction vessel is 1.46 at 65° C. An aqueous solution of sodium bromide (solution B-1, 2.12 molar) and silver nitrate (solution C-1, 1.18 molar) are added by double jet addition using accelerated flow with pBr controlled at 1.46 at 65° C. An aqueous solution of sodium bromide (solution B-2, 4.78 molar) is then added with vigorous stirring. The pBr of the contents of the reaction vessel are 0.915 at 65° C. Two liters of aqeous phthalated gelatin solution (solution E, 2% by weight) are added, followed by the addition of silver iodide seed (solution G, 0.936 moles) with good stirring. The mixture in the vessel is then held for two minutes at 65° C. with further stirring. At the end of the two-minute hold, 42.4 cc of an aqueous solution of potassium selenocyanate (solution H, 0.0012 molar) is added with good stirring. The mixture in the vessel is held for another two minutes at 65° C. with further stirring. At the end of the two-minute hold, an aqueous solution of silver nitrate (solution C-2, 1.88 molar) is added until a pBr of 2.45 is reached. Approximately 83.7% of the total silver is used. Thirty-six moles of silver are used to prepare this emulsion. The double jet, accelerated flow rate used is 10.5 times from start of the growth segment to finish, over 72 minutes and 40 seconds. The emulsion is cooled to 40° C., then coagulation washed twice.

A control emulsion is precipitated in the same manner as above, except the dopant potassium selenocyanate (solution H) is omitted.

Both of these emulsions are sensitized with 150 mg/Ag mole sodium thiocyanate, 4.5 mg/Ag mole sodium thiosulfate, 1.5 mg/Ag mole potassium tetrachloroaurate and 17 mg/Ag mole 3-methylbenzothiazolium iodide, and spectrally sensitized with 228 mg/Ag mole of dye E and 386 mg/Ag mole of dye F. The sensitized emulsion is combined with a cyan coupler 2-naphthalenecarboxamide, N-[4-[2,4-6(1,1-dimethylpropyl) phenoxy]butyl]-1 hydroxy in an amount of 55 mg/silver mole, then coated onto a polyester film, exposed for 1/100 second at 5500K, and processed in C-41 developer for two minutes and fifteen seconds. The photographic test results show that the selenium doped emulsion is 0.14 log E faster than the control emulsion without the dopant.

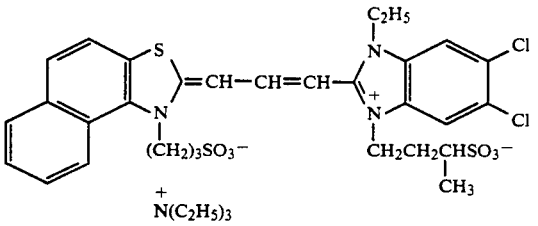

The invention has been described with preferred tabular silver halide emulsions. However the invention also would find advantages in doping of other types of silver halide grains for improved speed/fog and raw stock keeping. Further the invention also would find utilization in the formation of black and white films where improved speed/fog grain ratio is desirable as well as improved raw stock keeping. The invention is only intended to be limited by the scope of the claims attached hereto.

The invention has been described in detail with particular reference to preferred embodiments thereof, but it will be understood that variations and modifications can be effected within the spirit and scope of the invention.

I claim:

1. A method of forming forming silver halide grains comprising forming a precipitation dispersion for silver halide grains, precipitating silver halide grains by introducing silver and halide salts into the precipitation, after about 65 to about 90 percent of the silver salt that will form the silver mass to be precipitated has been added, adding to said precipitation dispersion selenium salt dopant in an amount to about $1.4\times10^{-6}$ mole per mole of silver, based on the total mass of silver to be precipitated, continuing precipitation until all the silver mass has been added and said silver halide grains reach a desired size, ending the precipitation process, and recovering said grains, said grains comprising silver, iodide and bromide, and said grains having of an aspect ratio of at least 8 to 1.

2. The method of claim 1 wherein said silver halide grains are precipitated utilizing an accelerated double jet technique.

3. The method of claim 1 wherein said ending precipitation is performed by coagulation washing to remove bromide ion.

4. The method of claim 1 wherein about 67 percent of said silver salt has been added when said selenium salt is added to said precipitation dispersion.

5. The method of claim 1 wherein after precipitation is ended said grains are sensitized, couplers and other addenda added, and the emulsion is coated as a layer of photographic film.

6. The method of claim 1 wherein said selenium salt comprises potassium selenocyanate.

7. The method of claim 1 wherein said salt comprises a metallic selenium salt.

8. The method of claim 1 wherein said selenium salt comprises an organo metallic salt.

9. The method of claim 8 wherein said organo metallic salt comprises a seleno thiourea salt.

10. The method of claim 1 wherein said silver halide grains comprise between 1 and 44 mole percent of silver iodide.

11. The method of claim 9 wherein said silver halide grains comprise between about 1 and 12 mole percent of silver iodide.

12. The method of claim 11 wherein said aspect ratio is at least 20 to 1.

13. Photo sensitive silver halide grains comprising silver halide grains comprising silver, bromide, iodide, and about $1.4\times10^{-6}$ mole selenium per mole of silver, said grains having an aspect ratio of at least 8 to 1 and about the outer third of said grains comprise selenium.

14. The grains of claim 13 wherein the sub-surfaces of said grains comprise selenium.

* * * * *